US007100738B1

(12) United States Patent
Diggle, III et al.

(10) Patent No.: US 7,100,738 B1
(45) Date of Patent: Sep. 5, 2006

(54) CLIMBING DEVICE

(75) Inventors: Frederick James Diggle, III, Birmingham, AL (US); Michael L. White, Boaz, AL (US)

(73) Assignee: BellSouth Intellectual Property Corp., Wilmington, DE (US)

( * ) Notice: Subject to any disclaimer, the term of this patent is extended or adjusted under 35 U.S.C. 154(b) by 8 days.

(21) Appl. No.: 10/639,973

(22) Filed: Aug. 13, 2003

(51) Int. Cl.
*A62B 37/00* (2006.01)

(52) U.S. Cl. ..... 182/9; 248/230.3

(58) Field of Classification Search ..... 182/9, 182/187; 248/229.12, 229.22, 228.3, 230.3, 248/231.41, 219.4, 230.2, 230.5, 297.51
See application file for complete search history.

(56) References Cited

U.S. PATENT DOCUMENTS

| | | | | |
|---|---|---|---|---|
| 117,413 | A | 7/1871 | Hanger | |
| 1,271,583 | A * | 7/1918 | Ketler | 126/252 |
| 1,721,516 | A | 7/1929 | Jacobs | |
| 2,152,049 | A | 3/1939 | Hedrick | |
| 2,252,998 | A | 8/1941 | Wachtel | |
| 2,290,318 | A | 7/1942 | Dieke, Jr. et al. | |
| 2,544,963 | A * | 3/1951 | Livingston | 248/230.1 |
| 2,910,135 | A * | 10/1959 | Moore | 182/113 |
| 3,530,996 | A * | 9/1970 | Schaffer | 211/107 |
| 3,647,171 | A | 3/1972 | Rafferty | |
| 3,743,050 | A | 7/1973 | Danz | |
| 3,776,549 | A * | 12/1973 | Ganis | 473/483 |
| 3,787,015 | A * | 1/1974 | Ablett | 248/539 |
| 3,840,091 | A | 10/1974 | Conlon | |
| 4,137,995 | A | 2/1979 | Fonte | |
| 4,159,044 | A | 6/1979 | Wydia | |
| 4,225,013 | A * | 9/1980 | Sample | 182/134 |
| 4,358,080 | A | 11/1982 | Worker | |
| 4,407,391 | A | 10/1983 | Greenway et al. | |
| 4,506,762 | A | 3/1985 | Bednar | |
| 4,527,660 | A | 7/1985 | Andruchiw | |
| 4,572,329 | A | 2/1986 | Kleveborn | |
| 4,679,658 | A | 7/1987 | Demers | |
| 4,876,810 | A | 10/1989 | Piana et al. | |
| 4,923,048 | A | 5/1990 | Cole | |
| 4,951,778 | A | 8/1990 | Halvorson | |
| 5,052,514 | A | 10/1991 | Rezmer | |
| 5,165,499 | A | 11/1992 | Bell | |
| 5,180,030 | A | 1/1993 | Smaby | |
| 5,190,392 | A * | 3/1993 | Parma et al. | 403/171 |
| D335,351 | S | 5/1993 | Melnick | |
| 5,222,991 | A | 6/1993 | Bell | |
| 5,341,896 | A | 8/1994 | Amacker | |
| 6,041,891 | A | 3/2000 | Fullman et al. | |

(Continued)

OTHER PUBLICATIONS

Express Mail Label No. EU 560 994 055 US.

(Continued)

*Primary Examiner*—Alvin Chin-Shue
(74) *Attorney, Agent, or Firm*—Withers & Keys, LLC

(57) ABSTRACT

A safety device is disclosed. According to various embodiments, the safety device includes a frame having a main lever arm and a connecting portion, wherein the connecting portion comprises a surface having a plurality of indentations and wherein the main lever arm includes a first elbow and a first upward extending arm at an end opposite the connecting portion. The safety device also comprises an expander lever arm, wherein the expander lever arm includes a second elbow and a second upward extending arm at the end opposite the connecting portion, wherein the main lever arm and the expander lever arm divergently extend from the connecting portion and wherein the expander lever arm is configured to engage and to be adjustable about the connecting portion.

10 Claims, 11 Drawing Sheets

U.S. PATENT DOCUMENTS 6,070,849 A 6/2000 Larmande et al.
6,076,633 A * 6/2000 Whitmer ..... 182/36
6,079,761 A 6/2000 Sadeck
6,206,138 B1 3/2001 Yerger
6,223,854 B1 5/2001 Nolz
6,241,045 B1 6/2001 Reeve et al.
6,471,002 B1 10/2002 Weinerman
6,644,438 B1 11/2003 Chang et al.
6,752,242 B1 6/2004 Whitehead et al.
6,779,738 B1 8/2004 Stannard

OTHER PUBLICATIONS

U.S. Appl. No. 10/409,013, filed Apr. 8, 2003.
U.S. Appl. No. 10/641,311, filed Aug. 14, 2003.
U.S. Appl. No. 10/646,137, filed Aug. 22, 2003.
U.S. Appl. No. 10/650,276, filed Aug. 27, 2003.

* cited by examiner

CLIMBING DEVICE

BACKGROUND

In the telecommunications or electronics industry, it is common practice for a technician (also referred to as a "linesman") to climb a columnar member, such as, for example, a pole, a tree trunk, and the like to install equipment, to repair broken or damaged communications equipment, to test equipment, and/or to perform other work-related tasks. To safely and effectively climb the columnar member and perform line work, the technician must maintain and properly utilize various types of climbing equipment.

As a result, technicians employ climbing equipment that conventionally includes a pair of gaffs, a body belt, and/or a safety strap. In general, the gaff is a sharp blade protruding from the inside of the technician's footwear about mid-foot level and having straps that secure about the leg and/or feet of a technician. To climb a columnar member such as, for example, a pole, the technician drives one of the gaffs into the pole, steps up onto the gaff, and then drives the other gaff into the pole at a higher position. The technician continues taking steps up or "gaffs up" the pole until reaching a desired height.

The body belt is secured around the waist of the technician. The body belt includes pockets for carrying tools and rings (e.g., "D-rings") for attaching the safety strap. The safety strap may include a hook (e.g., snap buckle) at each end and a buckle for adjusting its length. During climbing, both hooks of the safety strap are attached to the same ring of the body belt on the technician's left hip. Once in a position to perform line work, the technician releases one end of the safety strap from the body belt and wraps the safety strap around the pole. The technician then reattaches the end of the safety strap to a right D-ring on the belt to support his/her body, thus freeing the technician to use his/her hands at a desired working elevation about the pole.

During elevated line work, both gaffs are pressed into the pole and the technician leans back against the safety strap. This position allows the weight of the technician to be supported by the gaffs and the tension in the safety strap.

SUMMARY

In one general respect, embodiments of the present invention are directed to a safety device. According to such embodiments, the safety device includes a frame having a main lever arm and a connecting portion, wherein the connecting portion comprises a surface having a plurality of indentations and wherein the main lever arm includes a first elbow and a first upward extending arm at an end opposite the connecting portion. The safety device also comprises an expander lever arm, wherein the expander lever arm includes a second elbow and a second upward extending arm at the end opposite the connecting portion, wherein the main lever arm and the expander lever arm divergently extend from the connecting portion and wherein the expander lever arm is configured to engage and to be adjustable about the connecting portion.

DESCRIPTION OF THE DRAWINGS

Embodiments of the present invention are described herein in conjunction with the following figures, wherein.

DESCRIPTION

Figure 1:
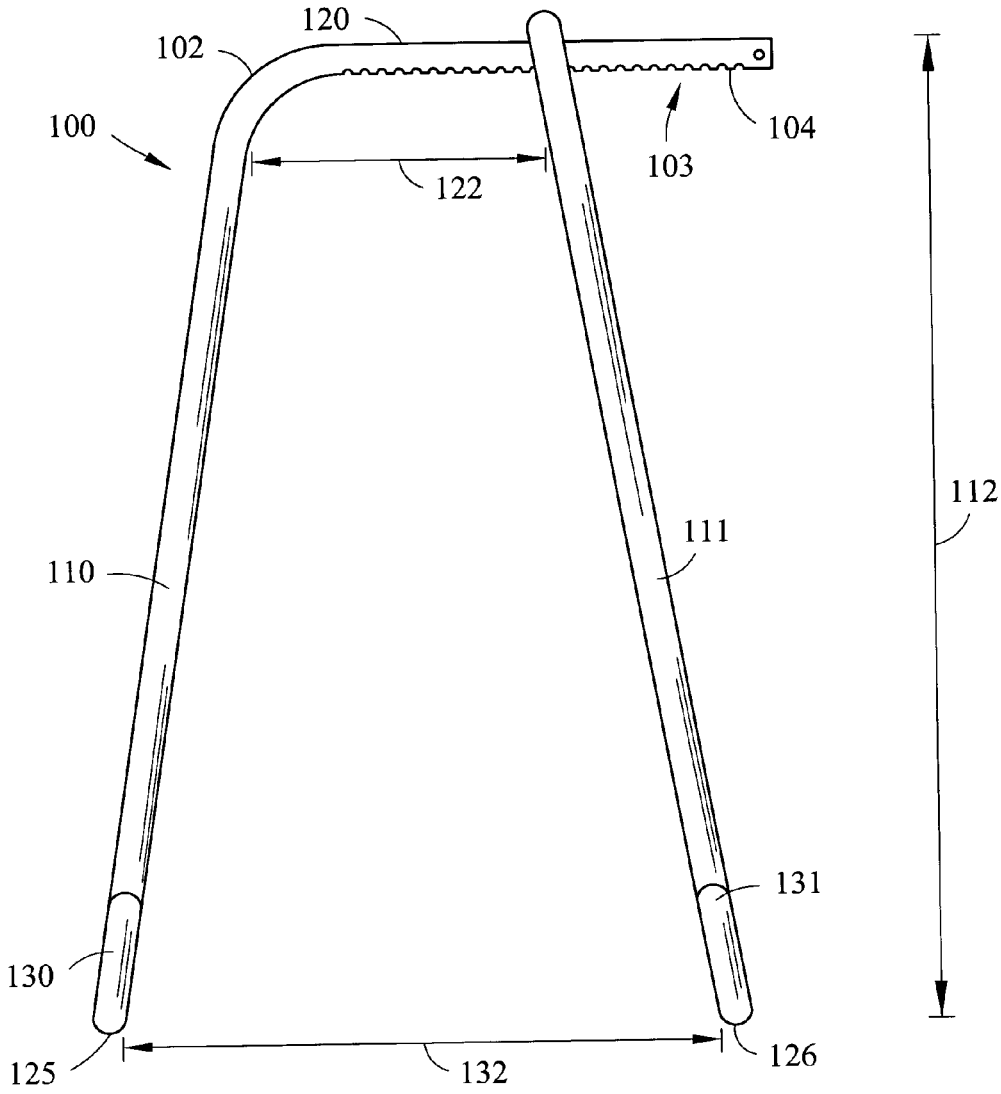
FIG. 1 is a front view of a technician catcher safety device according to embodiments of the present invention.

Referring now to the several drawings in which identical elements are numbered identically throughout, a description of the safety device now will be provided, in which exemplary embodiments are shown in the several figures. The safety device may, however, be embodied in many different forms and should not be construed as limited to the embodiments set forth herein. Rather, these embodiments are provided so that this disclosure will be thorough and complete, and will fully convey the scope of the invention to those having ordinary skill in the art.

All statements herein reciting embodiments of the present invention, as well as specific examples thereof, are intended to encompass both structural and functional equivalents thereof. Moreover, it is intended that such equivalents include both currently known equivalents as well as equivalents developed in the future for performing the same function, regardless of structure. Thus, those skilled in the art will appreciate that the drawings presented herein and the like, represent conceptual views of illustrative structures which may embody the various aspects of this invention.

It can be appreciated that commercial entities and other organizations that employ workers in elevated environments are aware of the potential risks attendant upon work performed in such environments. In view of this awareness, commercial entities and other organizations devote time and resources to promoting the safety of workers performing work in elevated environments to make the performance of work as safe as possible. Promoting safety of workers in elevated environments may involve instituting training programs and/or providing workers with a variety of support devices, support systems, backup devices and systems, and/or other means that promote the stability and safety of workers in elevated environments. Despite the best efforts of an organization to enhance the safety of its workers and reduce the risk of falling from elevated structures, for example, it is nonetheless difficult to eliminate all risks to workers performing work on such elevated structures.

Redundant systems for promoting safety of workers on elevated utility structures may thus sometimes be used. Such redundant systems can sometimes be beneficial in addition to the myriad of existing support systems, methods, devices and/or other apparatus employed by workers on elevated structures to reduce or mitigate risks associated with falling from utility structures, for example.

It is to be understood that the figures and descriptions of the safety device have been simplified to illustrate elements that are relevant for a clear understanding of the safety device, while eliminating, for purposes of clarity, other elements of conventional climbing safety devices. For example, conventional climbing safety devices may include certain brackets, accessories and clips that are not described herein. Those of ordinary skill in the art will recognize, however, that these and other elements may be desirable in a typical climbing safety device. However, because such elements are well known in the art and because they do not facilitate a better understanding of the safety device, a discussion of such elements is not provided herein.

Also, in the claims appended hereto, any element expressed as a means for performing a specified function is to encompass any way of performing that function including, for example, a combination of elements that perform that function. Furthermore the invention, as defined by such means-plus-function claims, resides in the fact that the functionalities provided by the various recited means are combined and brought together in the manner for which the claims recite. Therefore, any means that can provide such functionalities may be considered equivalents to the means shown herein.

FIGS. 1–11 illustrate embodiments of a climbing device that attaches to columnar members of varying sizes, such as, for example, a pole, a tree trunk, and the like. In addition, the climbing device, which may also be referred to herein as a "technician catcher safety device" and a "safety device", may also catch and support a technician who has descended from a desired working elevation about the columnar member.

FIG. 1 illustrates a front view of a technician catcher safety device 100 according to one embodiment of the present invention. According to this embodiment, the technician catcher safety device 100 may include an expander lever arm 111 and a frame 102 having a main lever arm 110 and a connecting portion 120. The connecting portion 120 may comprise a surface 103 having a plurality of indentations 104 that may, for example, couple the expander lever arm 111 to the main lever arm 110 via, for example, V-shaped, U-shaped, wave-shaped and/or rectangular shaped indentations.

Both the expander lever arm 111 and the main lever arm 110 may divergently extend outward from the connecting portion 120 such that the expander lever arm 111 and the main lever arm 110 extend about a variety of circumferences of a columnar member, such as, for example, a pole, a tree trunk, and the like. According to such embodiments, the expander lever arm 111 may also engage and be adjustable about the connecting portion 120. In addition, the main lever arm 110 and the expander lever arm 111 may also include a first elbow 125 and a second elbow 126 respectively, at an end opposite the connecting portion 120 according to various embodiments of the present invention.

In various example embodiments, a first internal width 132 at the end opposite the connecting portion 120 may be approximately fifteen (15) inches, a second internal width 122 of the connecting portion 120 may be approximately seven (7) inches and the length 112 of the main lever arm 110 and the expander lever arm 111 may be approximately twenty-three (23) inches. However, as one of ordinary skill in the art will appreciate, these measurements may vary without departing from the scope and spirit of the present invention.

According various embodiments, the technician catcher safety device 100 may be manufactured using any appropriate material that can withstand a wide range of temperatures, humidity, moisture, and other environmental conditions and can support the weight of a descended technician, as well as any applied increased force resulting from the descent. For example, the technician catcher safety device 100 may be formed of steel tubing, titanium, aluminum, and any other appropriate, light-weight metals. The technician catcher safety device 100 may also be constructed of polymer, plastic, composite, ceramic, glass, crystal, and/or other materials and combinations of materials capable of being used as described herein. In addition, the technician catcher safety device 100 may also have a durable finish coating adequate to withstand outdoor environmental conditions, such as, for example, a polyurethane powder coating.

Figure 2:
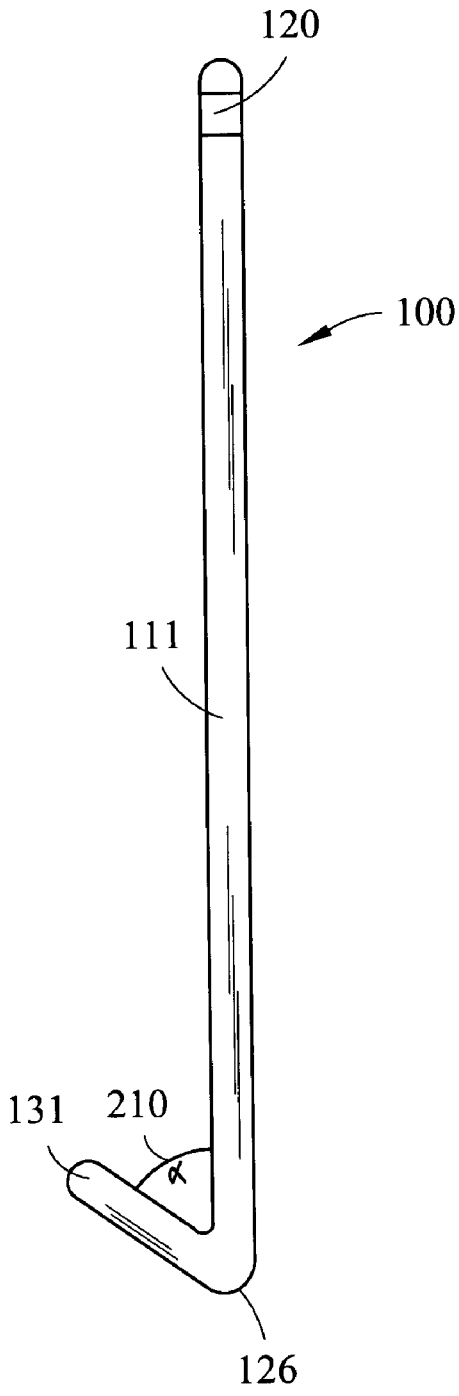
FIG. 2 is a side view of the technician catcher safety device of FIG. 1.

FIG. 2 illustrates a side view of the technician catcher safety device 100. In one embodiment, the second elbow 126 may connect the attached expander lever arm 111 to an upwardly extending arm 131 at an angle $\alpha$ (shown as reference numeral 210). According to various embodiments, the angle $\alpha$ may have a value of approximately seventy degrees (70°) relative to the expander lever arm 111 such that the upwardly extending arm 131 functions as a "hook." In other embodiments, the angle $\alpha$ could range from, for example, about more than thirty degrees (30°) to about less than one hundred twenty degrees (120°) relative to the expander lever arm 111. Similar to the second elbow 126, the first elbow 125 may also connect the attached main lever arm 110 to an upwardly extending arm 130 such that the extending arm 130 also functions as a "hook."

Figure 3A:
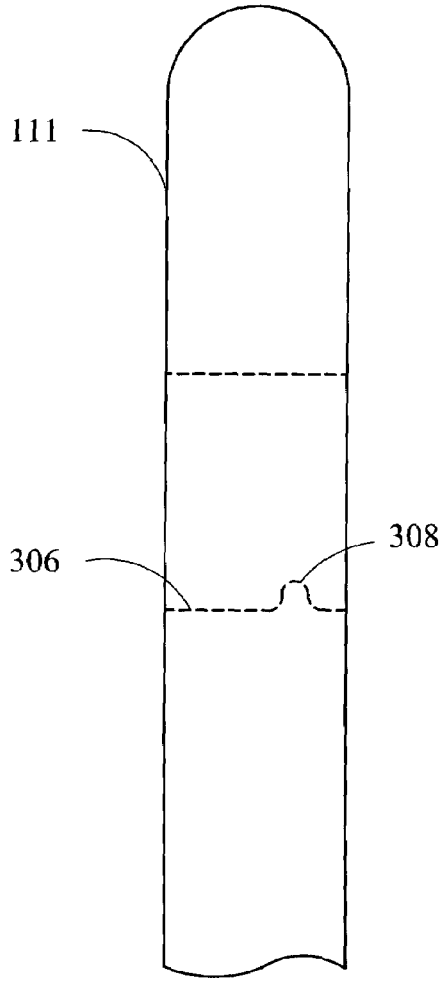
FIGS. 3A and 3B are front and side views of a technician catcher safety device according to embodiments of the present invention.
Figure 3B:
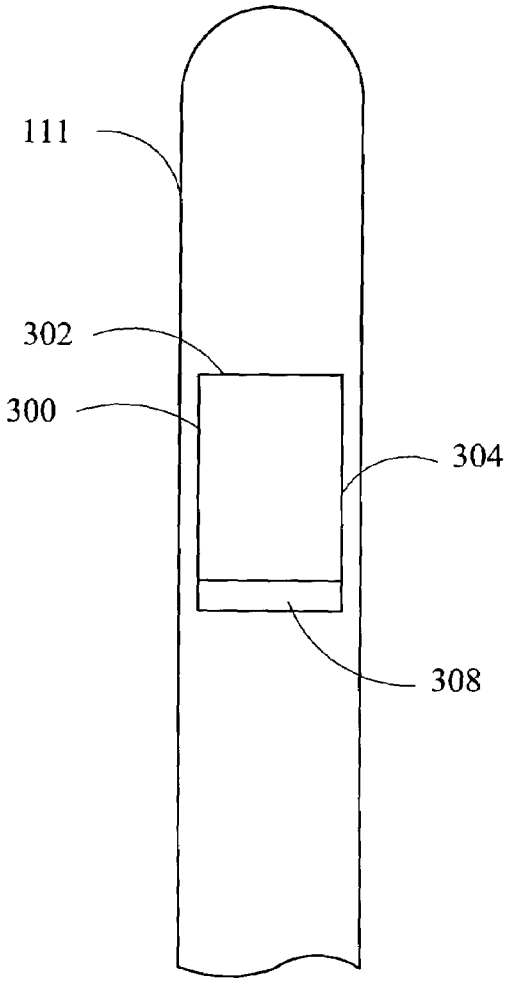

FIGS. 3A and 3B are a front view and a side view respectively of the expander lever arm 111. As illustrated therein, the expander lever arm 11 may include a first internal wall 300, a second internal wall 302 and a third internal wall 304, wherein the first 300, second 302 and third 304 internal walls are substantially planar. According to such embodiments, the expander lever arm 111 may also comprise a fourth internal wall 306 having an engagement surface 308 that engages the plurality of indentations 104 of the connecting portion 120.

In various embodiments, the first internal wall 300, the second internal wall 302, the third internal wall 304 and the fourth internal wall 306 may define an aperture therethrough, wherein the connecting portion 120 may be inserted into the aperture, thus enabling the expander lever arm 111 to bi-directionally slide along the connecting portion 120 and the engagement surface 308 to engage the plurality of indentations 104 of the connecting portion surface 103.

Figure 4:
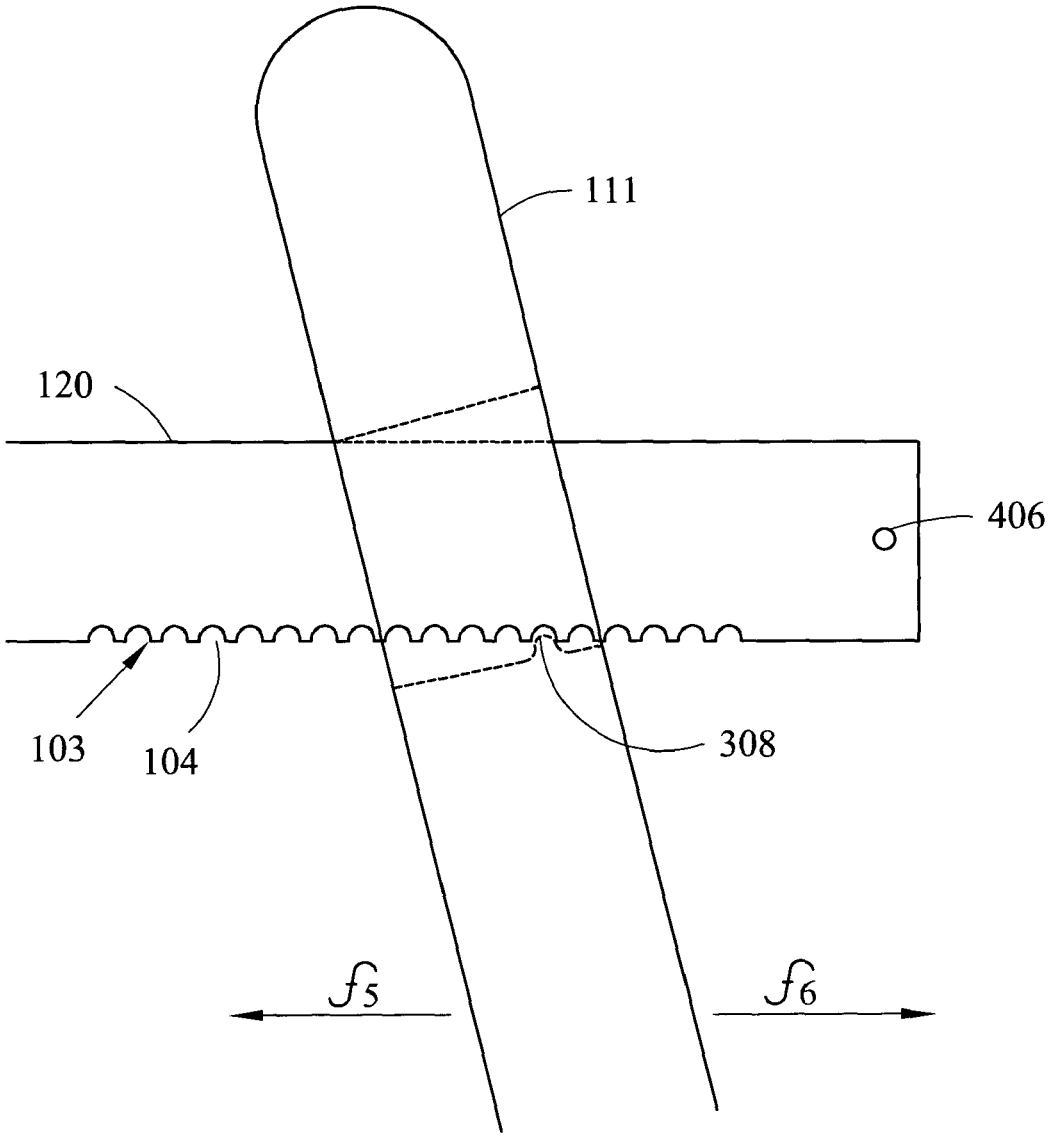
FIG. 4 is a front view of a technician catcher safety device according to embodiments of the present invention.

FIG. 4 depicts a front view of the engagement surface 308 engaging one of the plurality of indentations 104 of the connecting portion surface 103. Although FIG. 4 shows the engagement surface 308 in the form of a U-shaped protrusion, as one skilled in the art will appreciate the engagement surface 308 may be formed in a variety of shaped protrusions that mate with the plurality of indentations 104 such as, for example, V-shaped, wave-shaped, and rectangular shaped protrusions.

To apply the safety device 100 to columnar members of varying circumferences, the technician may adjust the expander lever arm 111 about the connecting portion 120 by exerting a horizontal force $f_5$ on the expander lever arm 111. By exerting horizontal force $f_5$, the engagement surface 308 disengages from one of the plurality of indentations 104, thus enabling the technician to bi-directionally slide the expander lever arm 111 along the connecting portion 120 and thus fit the safety device 100 about a particular circumference of a columnar member. After sliding the expander lever arm 111 to a desired position about the connecting portion 120, the technician may then lock the safety device 100 about the columnar member by exerting a horizontal force $f_6$. According to this embodiment, horizontal force $f_6$ drives the engagement surface 308 into one of the plurality of indentations 104, thus locking the expander lever arm 111 into the connecting portion 120.

In various embodiments, the safety device 100 may also include a securing member 406 that is detachably connected to the connecting portion 120 and is configured to prevent the expander lever arm 111 from sliding off the connecting portion 120. One skilled in the art will appreciate that this securing member 406 may embody, for example, a pin, bolt, screw, clip, clamp, lock, and/or bracket.

Figure 5:
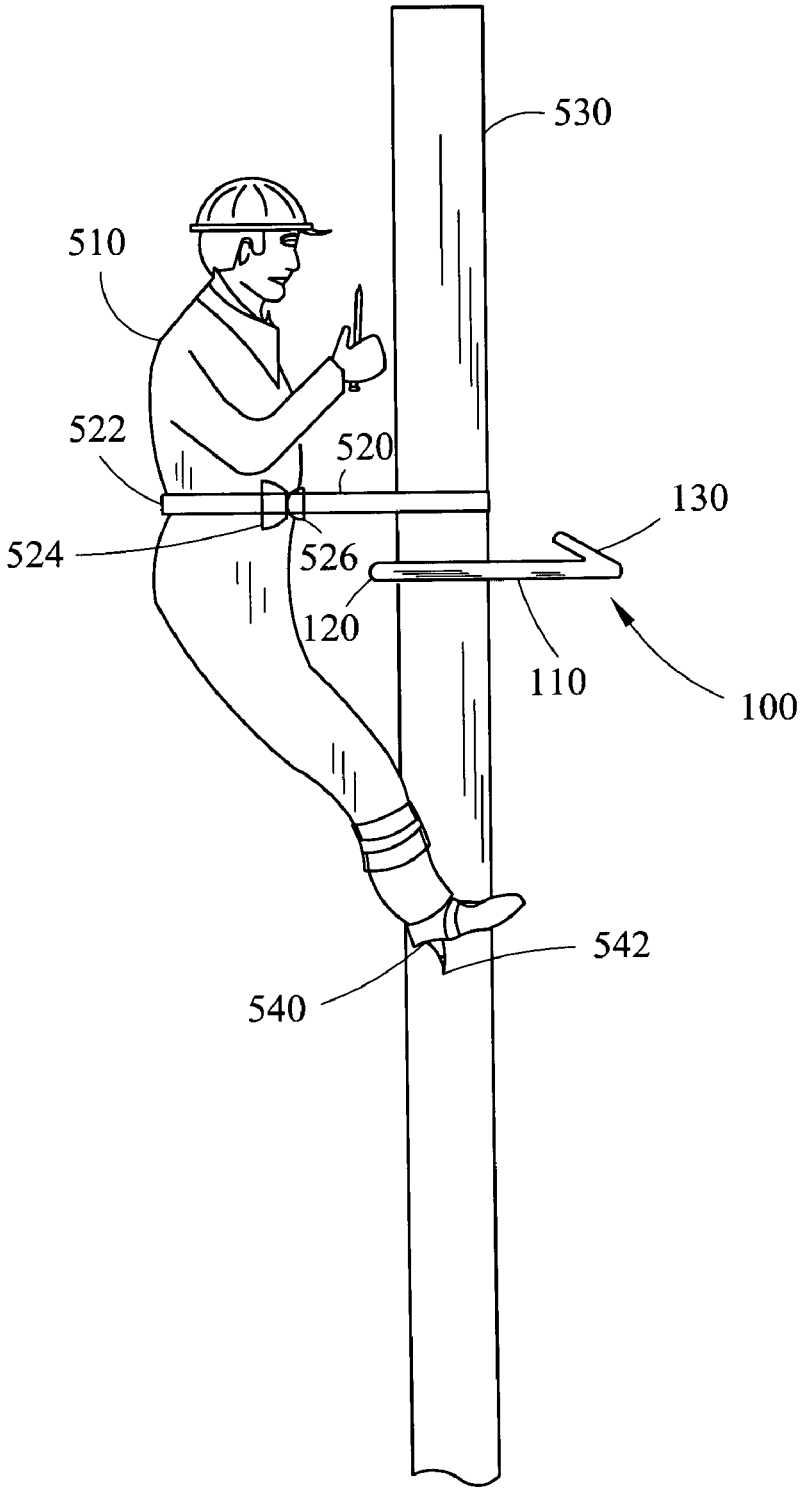
FIG. 5 is a side view of an elevated, secured technician and a technician catcher safety device according to embodiments of the present invention.
Figure 6:
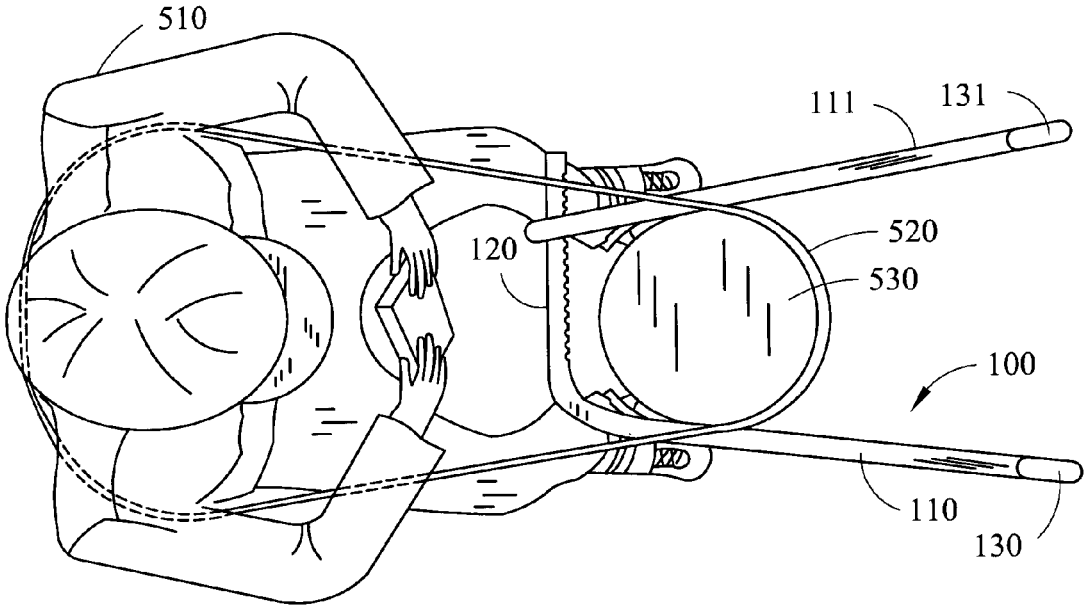
FIG. 6 is a top view of the elevated, secured technician and the technician catcher safety device of FIG. 5.

When performing elevated work on a columnar member, a technician may use the safety device as shown in FIGS. 5 and 6. FIG. 5 is a side view of an elevated, secured technician 510 and a technician catcher safety device 100 according to embodiments of the present invention and FIG. 6 is a top view of the technician 510 and the safety device 100 of FIG. 5. Examples of elevated work include, but are not limited to, installation, maintenance, testing, and/or other types of repair work on suspended equipment, such as, for example, terminals, wire pouches, J-hooks, network cable, transformers, and/or other types of hardware and equipment used in telecommunications and/or electrical industries. According to one embodiment, a technician 510 may position the technician catcher safety device 100 below a safety strap 520 extending about a columnar member 530. The columnar member 530 may be any type of pole, such as, for example, a telephone pole, an electrical pole, a tree trunk, and the like and may be tapered, such that a diameter of an upper portion of the pole 530 is less than the diameter of a lower portion of the pole 530.

As shown in FIGS. 5 and 6, the technician 510 wears a body belt 522 secured about the technician's waist. The body belt 522 may include a pair of locking members, shown as D-ring 524. The D-ring 524 or alternate locking members (not shown) may engage corresponding attachment members 526 (also shown as D-rings) on the ends of the safety strap 520. The safety strap 520 may extend around the pole 530 and connect with the body belt 522 worn by the technician 510. When the D-rings 524 of the body belt 522 are engaged with the attachment members 526 of the safety strap 520, the technician 510 may use the safety strap 520 for climbing as well as supporting the technician 510 at a desired working position on the pole 530. In addition, the technician 510 may utilize gaffs 540 having a bladed portion 542 that is driven into the pole 530 to assist the technician 510 in climbing and to prevent the technician 510 from losing his/her foothold with the pole 530. When the technician 510 is at a desired working position on the pole, the gaffs 540 and the safety strap 520 may support the weight of the technician 510 such that the technician can freely use his hands to perform the elevated work.

Once the technician 510 reaches a desired working position on the pole 530, the technician 510 may locate the technician catcher safety device 100 below and proximate to the safety strap 520 with a center of the connecting portion 120 facing the technician's body such that the upwardly extending arms 130 and 131 are positioned on the side of the pole 530 opposite the technician's body. According to one embodiment, the technician may also position the technician catcher safety device 100 around the pole 530 by wedging the main lever arm 110 and the expander lever arm 111 about the circumference of the pole 530 and thus frictionally engage the technician catcher safety device 100 with the pole 530.

Figure 7:
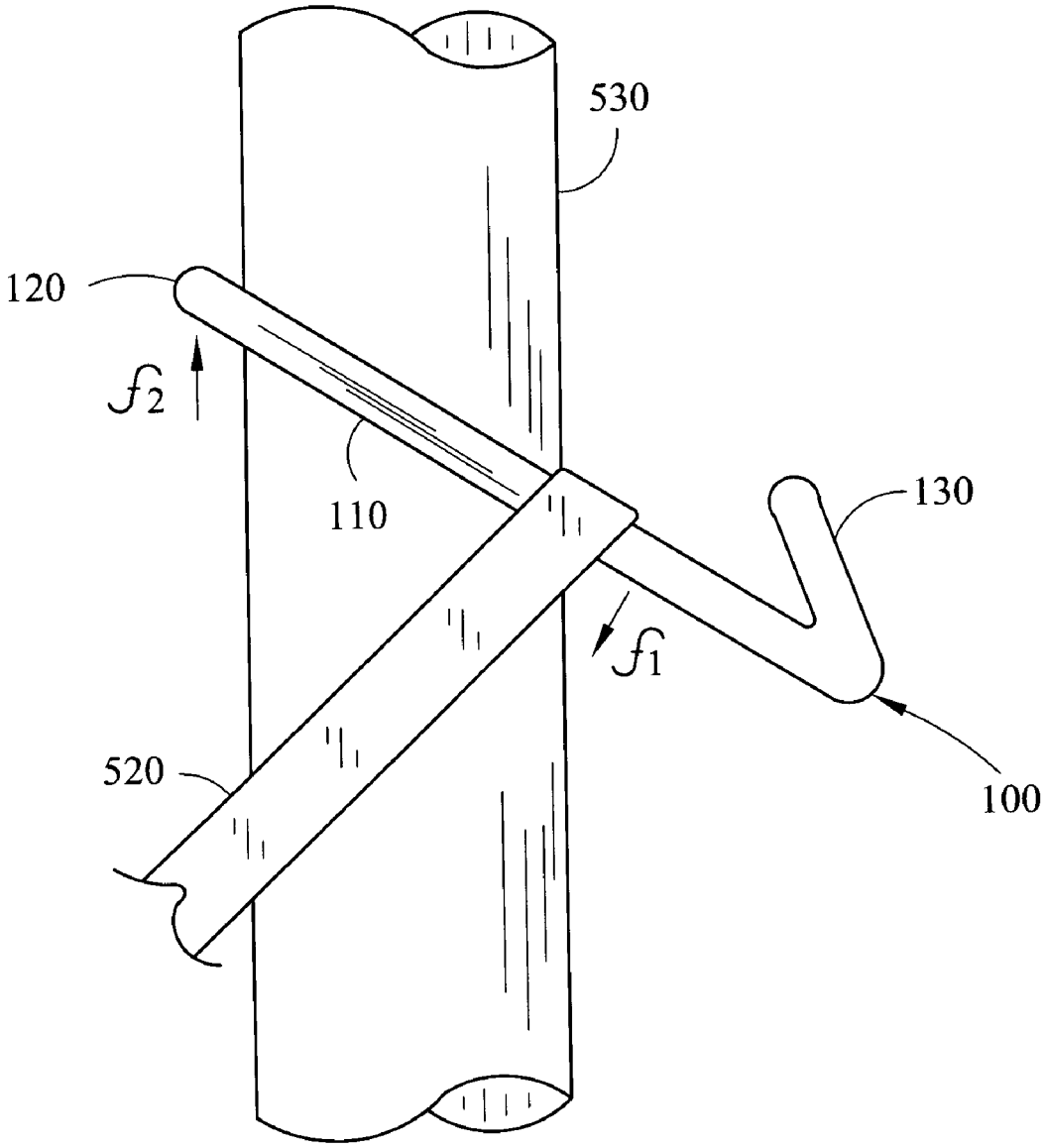
FIG. 7 is a side view of a technician catcher safety device according to embodiments of the present invention supporting a safety strap of a descended technician.
Figure 8:
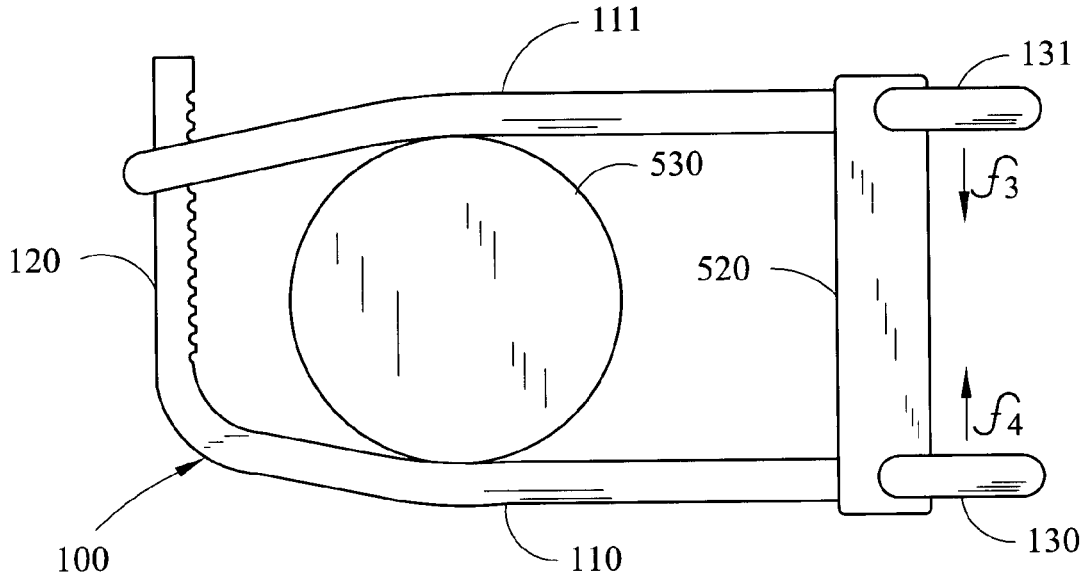
FIG. 8 is a top view of the technician catcher safety device of FIG. 7.

FIGS. 7 and 8 illustrate side and top views respectively of the technician catcher safety device 100 supporting the safety strap 520 of a descended technician (not shown). When the technician descends, the safety strap 520 of the technician may be caught by the main lever arm 110 and the expander lever arm 111 such that the safety strap 520 moves and/or slides towards the inside surfaces of the first elbow 125 and the second elbow 126. To facilitate the safety strap 520 sliding on the main lever arm 110 and the expander lever arm 111, a surface of the expander lever arm 111 and/or the main lever arm 110 may, according to one embodiment, comprise and/or be coated with a friction resistant material such as, for example, Teflon® or any other non-stick material.

According to various embodiments, the weight of the fallen technician may exert a downward force $f_1$ when the safety strap 520 slides to the elbows 130 and 131. This downward force $f_1$ acts on the expander lever arm 111 and/or the main lever arm 110 and may create a responsive upward force $f_2$ that acts on the central portion 120. In addition, the safety strap 520 may exert two additional forces $f_3$ and $f_4$ (shown in FIG. 8) at or near the ends of the main lever arm 110 and the expander lever arm 111 proximate to the elbows 130 and 131. Generated by the weight of the descended technician, forces $f_3$ and $f_4$ may squeeze the ends of the main lever arm 110 and the expander lever arm 111 together such that the technician catcher safety device 100 may frictionally engage the pole 530, causing the descended technician to arrive at a secured, stationary position. According to such embodiments, the technician catcher safety device 100 may support the weight of the descended technician and thus prevent the technician from further descending to the ground or an alternate lower surface.

Figure 9:
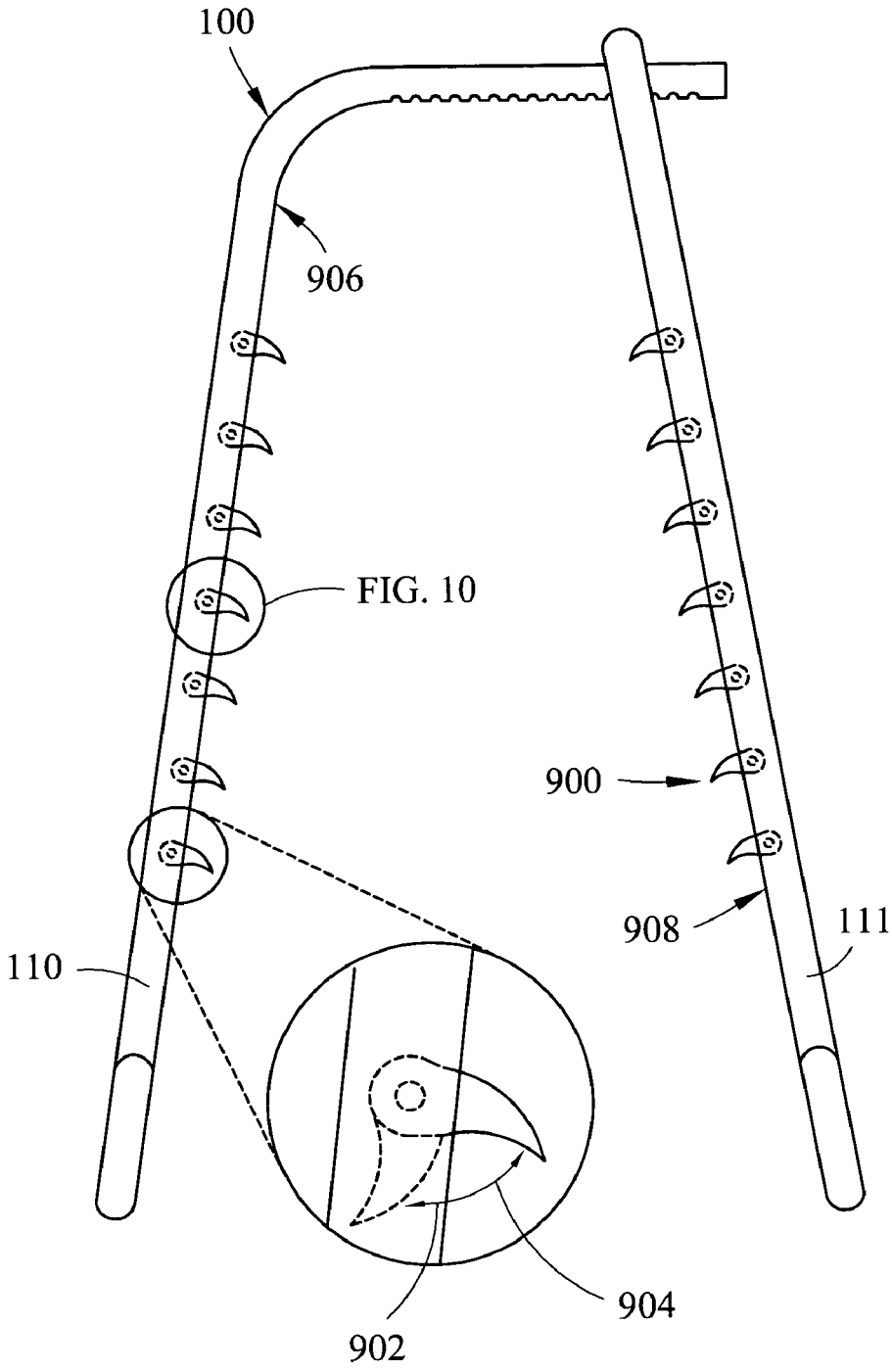
FIG. 9 is a front view of a technician catcher safety device according to embodiments of the present invention.
Figure 10:
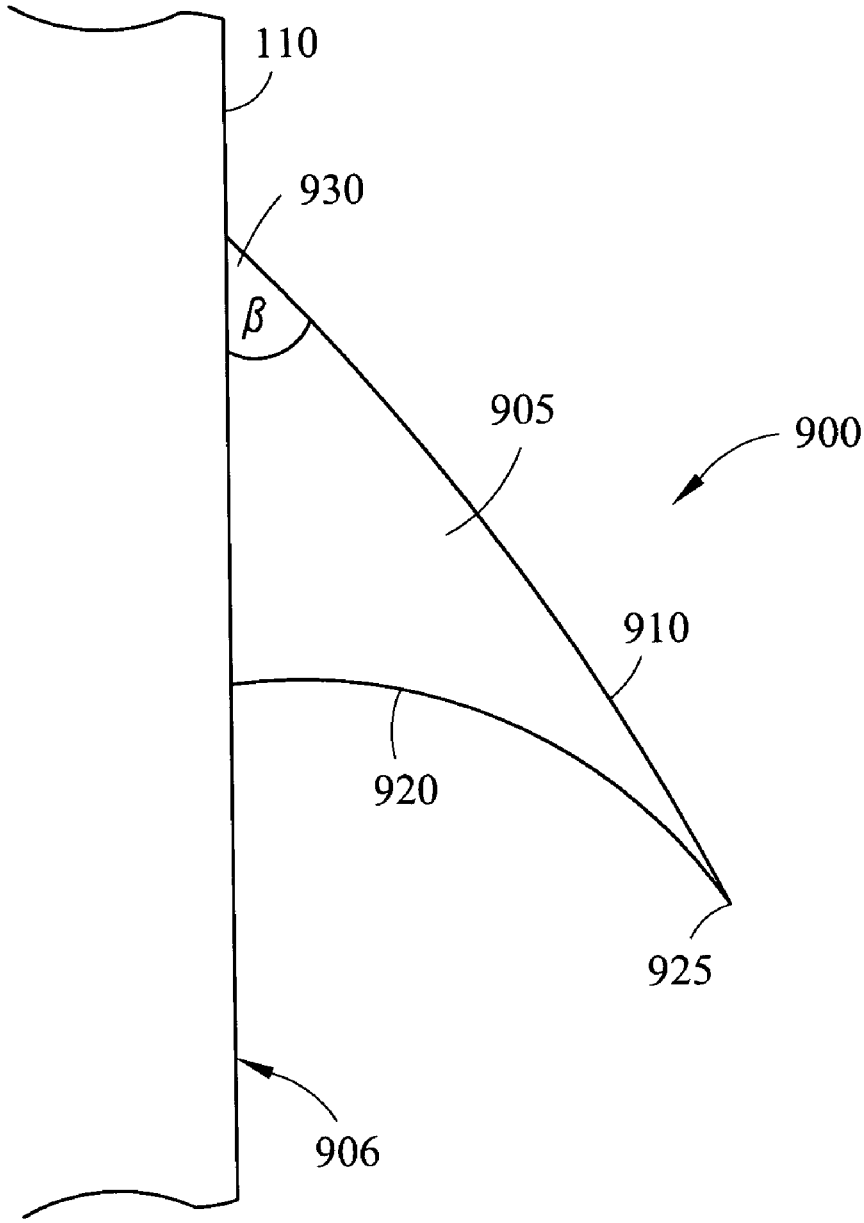
FIG. 10 is an enlarged front view of an attached gaff included in the technician catcher safety device of FIG. 9.

As shown in FIGS. 9 and 10, the technician catcher safety device 100 may further include, according to various embodiments, one or more toothed gaffs 900 along an inward surface 906 of the main lever arm 10 and/or an inward surface 908 of the expander lever arm 111. According to this embodiment, the toothed gaff 900 may be configured to engage (i.e. bite into) the surface of a columnar member. As shown in FIG. 10, the toothed gaff 900 may have a triangular shaped surface 905 having a hypotenuse 910 extending from surfaces 906 and 908 of the main lever arm 110 and/or the expander lever arm 1 respectively, at an angle β (shown as reference numeral 930), which may be, for example and in various embodiments, at least fifteen degrees. The leg 920 opposite angle β may be a curved, bladed surface having a tip 925 for further facilitating biting into the columnar member.

According to various embodiments, the toothed gaff 900 may retract in the direction of arrow 902 into inward surfaces 906 and/or 908 such that the toothed gaff 900 may be only extended in the direction of arrow 904 when the safety device 100 is positioned about a columnar member. According to various embodiments, the toothed gaff may extend at different angles and/or have different shapes so as to firmly secure the technician catcher safety device 100 to the columnar member. In various embodiments, inward surfaces 906 and 908 may also include a bladed edge that engages the columnar member.

Figure 11:
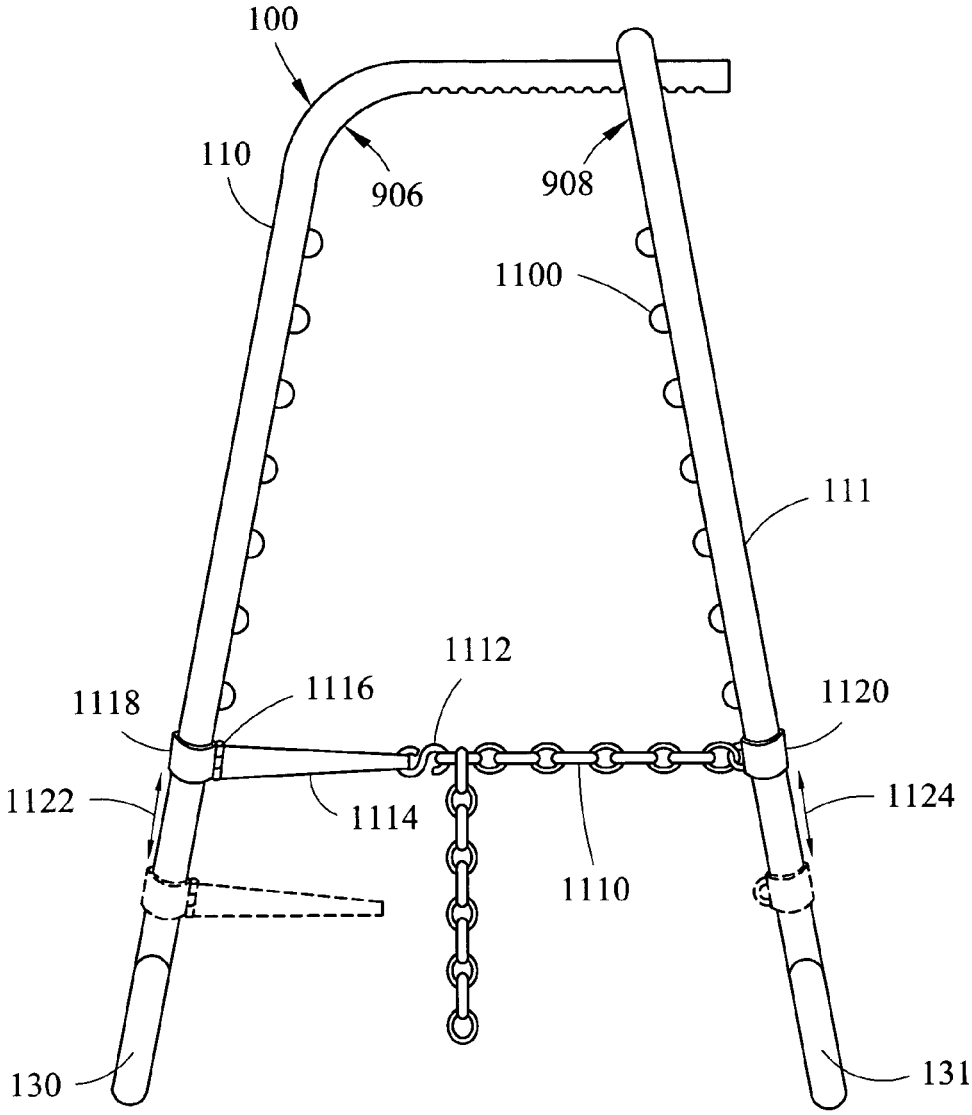
FIG. 11 is a front view of a technician catcher safety device according to embodiments of the present invention.

As shown in FIG. 11, the technician catcher safety device 100 may further include one or more ridge-like gripping surfaces 1100 along at least one of the inward surfaces 906 and 908 of the main lever arm 110 and/or the expander lever arm 111 respectively. Although each of the gripping surfaces 1100 may facilitate engagement of a columnar member, the technician may safely handle the gripping surface 1100 such as, for example, when the technician carries the safety device 100 while climbing a columnar member.

FIG. 11 also shows a first attachment member 1118 attached to the main lever arm 110 and a second attachment member 1120 attached to the expander lever arm 111. According to such embodiments, both the first attachment member 1118 and the second attachment member 1120 may be configured to bi-directionally slide along the main lever arm 110 and the expander lever arm 111 in directions shown by arrows 1122 and 1124. The safety device 100 may also include a transverse member 1110, wherein a first end of the transverse member 1110 may be secured to the second attachment member 1120. According to various embodiments, the transverse member may include a chain, cable and/or rope.

In addition, a first end of a link supporting arm 1114 may be pivotally secured by a pivot member 1116 to the first attachment member 1118, and a clip 1112 may detachably engage a second end of the link supporting arm 1114 and a second end of the transverse member 1110. According to various embodiments, the pivot member 1116 may include a nut, bolt, screw, rivet, and/or welding to secure the link supporting arm 1114 to the main lever arm 110.

While several embodiments of the invention have been described, it should be apparent, however, that various modifications, alterations and adaptations to those embodiments may occur to persons skilled in the art with the attainment of some or all of the advantages of the present invention. For example, the main lever arms 110 and the expander lever arm 111 may take on alternate shapes, such that they may be curved, flexible, or otherwise designed to position, support, or otherwise hold a fallen technician. The described embodiments are therefore intended to cover all such modifications, alterations and adaptations without departing from the scope and spirit of the present invention as defined by the appended claims.

What is claimed is:

1. A safety device, comprising:

a frame having a main lever arm and a connecting portion, wherein the connecting portion comprises a surface having a plurality of indentations and wherein the main lever arm includes a first elbow and a first upward extending arm at an end opposite the connecting portion; and an expander lever arm wherein the expander lever arm includes a second elbow and a second upward extending arm at the end opposite the connecting portion, wherein the main lever arm and the expander lever arm divergently extend from the connecting portion and wherein the expander lever arm is configured to engage and be adjustable about the connecting portion, and wherein the expander lever arm further comprises:

a first internal wall, wherein the first internal wall is substantially planar;

a second internal wall, wherein the second internal wall is substantially planar;

a third internal wall, wherein the third internal wall is substantially planar;

a fourth internal wall having an engagement surface; and wherein the first, second, third and fourth internal walls define an aperture therethrough, wherein the connecting portion is inserted through the aperture, wherein the expander lever arm bi-directionally slides along the connecting portion until the engagement surface is forced into engagement with the connecting portion surface having the plurality of indentions.

2. The safety device of claim 1, wherein the main lever arm and the expander lever arm are configured to engage a columnar member to support a suspended weight.

3. The safety device of claim 1, wherein the first elbow connects the main lever arm to the first extending arm.

4. The safety device of claim 1, wherein the second elbow connects the expander lever arm to the second extending arm.

5. The safety device of claim 1, wherein the plurality of indentations are at least one of V-shaped, U-shaped, wave-shaped, and rectangular shaped indentations.

6. The safety device of claim 1, wherein the engagement surface has at least one of V-shaped, U-shaped, wave-shaped, and rectangular shaped protrusions configured that are inserted into the one of the plurality of indentions of the connecting portion surface when the engagement lever is forced into engagement with the connecting portion.

7. The safety device of claim 1, further comprising a securing ember, wherein the securing member is detachably connected to the connecting portion and is configured to prevent the expander lever arm from sliding off the connecting portion.

8. The safety device of claim 7, wherein the securing member is one of a pin, bolt, screw, clip, clamp, lock and bracket.

9. The safety device of claim 1, wherein a surface of at least one of the expander lever arm and the main lever arm comprises a friction resistant material.

10. The safety device of claim 1, wherein the safety device includes at least one material selected from a group consisting of metal, polymer, plastic, ceramic, composite, glass, and crystal.

* * * * *